US005339663A

United States Patent [19]

Döring

[11] Patent Number: 5,339,663

[45] Date of Patent: Aug. 23, 1994

[54] LOCK CYLINDER

[75] Inventor: Ralf Döring, Heiligenhaus, Fed. Rep. of Germany

[73] Assignee: Carl Fuhr GmbH & Co., Heiligenhaus, Fed. Rep. of Germany

[21] Appl. No.: 921,902

[22] Filed: Jul. 29, 1992

[30] Foreign Application Priority Data

Aug. 14, 1991 [DE] Fed. Rep. of Germany ..... 4126792
May 12, 1992 [DE] Fed. Rep. of Germany ..... 4215560

[51] Int. Cl.[5] ..... E05B 9/10; E05B 17/04

[52] U.S. Cl. ..... 70/379 R; 70/372; 70/379 H

[58] Field of Search ..... 70/379 R, 379 A, 372, 70/375, DIG. 60, DIG. 62

[56] References Cited

U.S. PATENT DOCUMENTS 1,046,438 12/1912 Caldwell ..... 70/379 R
3,293,892 12/1966 Falk ..... 70/372
4,369,642 1/1983 Grell ..... 70/389
5,193,370 3/1993 Norden ..... 70/DIG. 60

FOREIGN PATENT DOCUMENTS 197236 9/1957 Fed. Rep. of Germany .... 70/379 R
1063924 8/1959 Fed. Rep. of Germany ..... 70/372
7247108 3/1973 Fed. Rep. of Germany .
1960900 10/1979 Fed. Rep. of Germany .... 70/DIG. 60

*Primary Examiner*—Peter M. Cuomo
*Assistant Examiner*—Darnell M. Boucher
*Attorney, Agent, or Firm*—Martin A. Farber

[57] ABSTRACT

A lock cylinder which can be actuated from one side by a knob and from the opposite side by a key, has a locking-member hub and a cylinder core which has tumblers adapted to be positioned by the key. A free passage is provided between a coupling member and a locking-member hub so that the coupling member entrains the locking-member hub only in one direction of rotation and can be freely turned back from the entrainment end position.

5 Claims, 6 Drawing Sheets 5
4
7
3
2
9
18
17
10'
10
21
22
20
18
17
27
6
1
19

4
2
7
11
10
21
F
65
64
48
52
56
55
57
61
1
22
20

36
30
28
21
27
39
37
31
41
29
24
40
51
48
52
53
57
55
54
68
67
33
34
20
22
1
35
32
42
25
44
23
50
VII
VIII
IX
X
F
26
47
49
59
58
56
38
32
25
42
29
51
50
48
53
61
57
64
65

LOCK CYLINDER

FIELD AND BACKGROUND OF THE INVENTION

The present invention relates to a lock cylinder which can be actuated by a knob on the one side and by a key on the opposite side, the cylinder having a locking-member hub arranged in the center region and rotatably connected to the knob and a coupling piece, arranged centrally to said hub, for transmitting the locking rotation caused by the key to the locking-member hub, and having a cylinder core which has tumblers adapted to be positioned by the key.

Such a lock cylinder is known from Federal Republic of Germany Utility Model 72 47 108, in which both the knob and the coupling member are connected in rotation to the locking-member hub. The coupling member is of approximately T-shape. Its crossbar which is developed as a rotary disk is rotatably mounted in a cavity in the inner end of the cylinder core while the T stem engages in form-locked manner into a recess in the center wall of the hub. A compression spring urges the coupling member in the direction towards the cylinder core. The displaceability of the coupling member is limited by the bottom of the cavity on the end of the cylinder core. The coupling member furthermore has an incision for the entrance of the tip of the key. After tumblers have been positioned, the tip of the key enters into the incision in the coupling member and carries the latter along, together with the locking-member hub and the knob. Upon a locking actuation by means of the knob, the locking-member hub and the coupling member are also carried along, while the cylinder core, which is blocked against turning by the tumblers, remains stationary. A lock cylinder developed in this manner is of complicated construction. Upon actuation by key, the locking force must be applied by the key or the key tip. Furthermore, a lock cylinder developed in this manner, when used in mortise locks, requires at least a 360° rotation of the locking-member hub in order to advance the bolt and then be able to withdraw the key.

SUMMARY OF THE INVENTION

The object of the present invention is so to develop a lock cylinder of the type in question, in a manner simple to manufacture, that the turning of the locking member is reduced to the amount necessary for the function of the bolt, while being easier to handle.

This object of the invention is achieved in a lock cylinder of this type by a free path between coupling member and locking-member hub in such a manner in that the coupling member carries the locking-member hub along in each case only in one direction of rotation and can be freely turned back from the entrained end position up into the key-removal position of the cylinder core.

As a result of this development there is created a lock cylinder of this type which is characterized on the one hand, by simpler construction and, on the other hand, by the fact that the turning of the locking member is reduced to the amount necessary for the operation of the bolt. Upon actuation of the lock cylinder by means of the key, the coupling member is directly carried along in rotation via the cylinder core. In this connection, the locking-member hub is carried along by the coupling member. As a result of the free passage between coupling member and locking-member hub, the coupling member can be freely turned back out of the entrainment end position up into the key-removal position of the cylinder core. The locking member is therefore not carried along. In actual practice, this takes the form, for instance, that a locking rotation of the locking member of about 135° can be effected. Upon the turning back into the key-removal position, the locking member remains stationary, due to the free passage between the locking-member hub and coupling member. Displacement of the locking member by this angular amount is possible also by means of the knob. It is not necessary to install an additional compression spring in the lock cylinder as in the prior art. The lock cylinder is therefore made less susceptible to disturbance in its construction. Since, upon the locking by the key, an angle of rotation less of than 180° in one or the other direction is moved over, handling is also facilitated. Furthermore, it is possible to retain the fundamental construction of the well-proven profiled lock cylinder, with the advantage of a limited locking rotation of the locking member and hub. A corresponding mortise lock therefore also requires less space for the locking-member hub.

One advantageous further feature consists therein that the coupling member, which is developed as a cylindrical pin, forms a semicircular annular collar the end surface of which come against stop surfaces of a driver vane thereof which extends into a free space in the locking-member hub. Upon the locking rotation by means of the key, the one stop surface of the driver vane is acted on by the corresponding end surface of the semicircular annular collar and the locking-member hub is thereby directly carried along. After the end entrainment position has been reached, it is then possible freely to turn the cylinder core back into the key-removal position, in which connection the other stop surface passes into entrainment-ready position with respect to the driver vane. Upon turning by means of the knob, the locking-member hub, which is coupled, fixed for rotation, with the knob, moves in such a manner that the driver vane passes from the one end surface of the annular collar to the other end surface.

From a structural standpoint, it is advantageous that the coupling member is in form-locked protrusion/slot engagement with the end side of the cylinder core. The assembling of the corresponding parts of the lock cylinder can, accordingly, be effected by plug-in assembly.

It is furthermore advantageous that, in different positions of rotation, the knob is seated changeably on a spindle which extends up into the locking-member hub and is coupled there to the latter in form-locked manner. By merely changing the knob, the lock cylinder can be used for both right-hand and left-hand locks. This results in advantages in manufacture as well as in storage and shipment. Additional parts are not required for the conversion.

Precise end positions of rotation are obtained in the manner that a disk is seated on the spindle between knob and end edge of the mounting cavity for the spindle, said disk engaging by means of a nose pointing in the direction of the locking-member hub into a circumferential recess in the spindle and forms rotation stops in combination with the side surfaces of an end-side free space. On the one hand, the nose serves for the form-locked entrainment of the spindle while, on the other hand, it is used to limit the end positions of rotation of the spindle and thus of the knob.

It has been found optimal for the disk to have two diametrically opposite noses facing in opposite directions, the nose facing away from the locking-member hub being adapted to be brought in, in each case, form-locked engagement with a depression in the knob. The one nose forms the coupling element between knob and disk, while the other nose is the coupling element between spindle and disk.

BRIEF DESCRIPTION OF THE DRAWINGS

One embodiment of the invention will be described below with reference to the drawings, in which.

DETAILED DESCRIPTION OF THE PREFERRED EMBODIMENT

Figure 1:
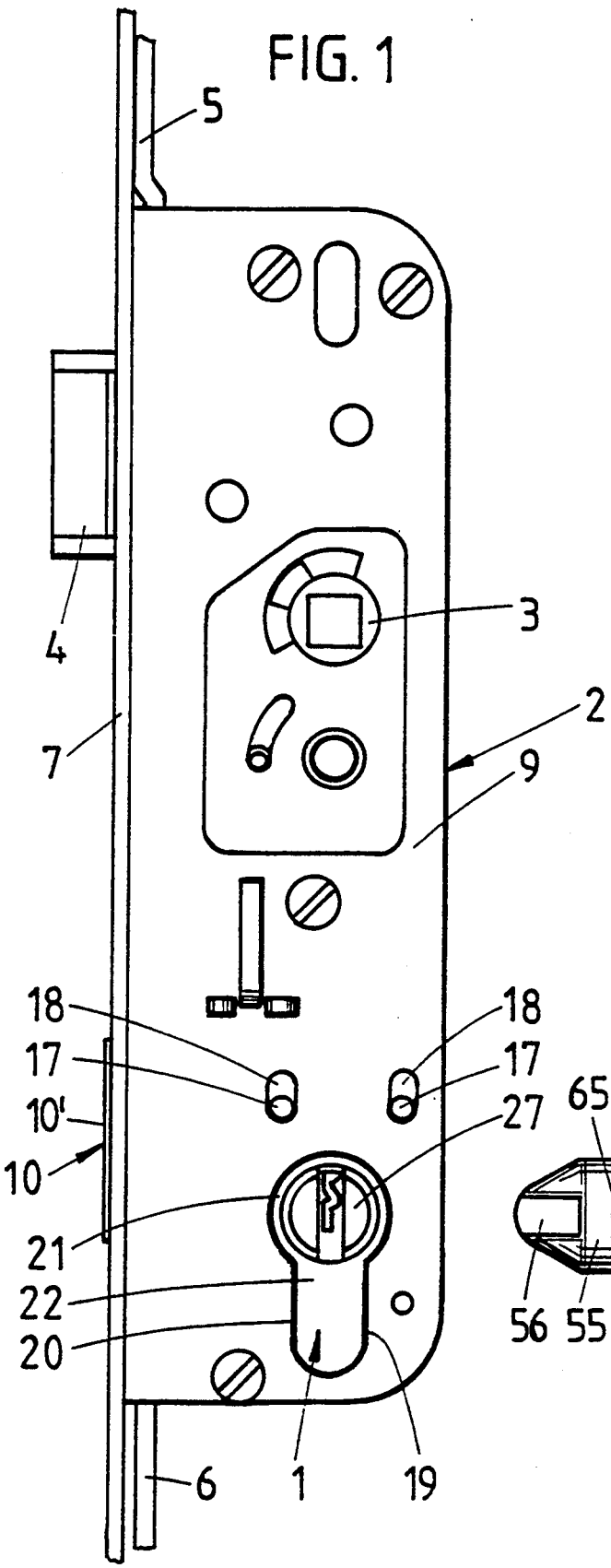
FIG. 1 is a view of a mortise lock provided with lock cylinder developed in accordance with the invention.
Figure 2:
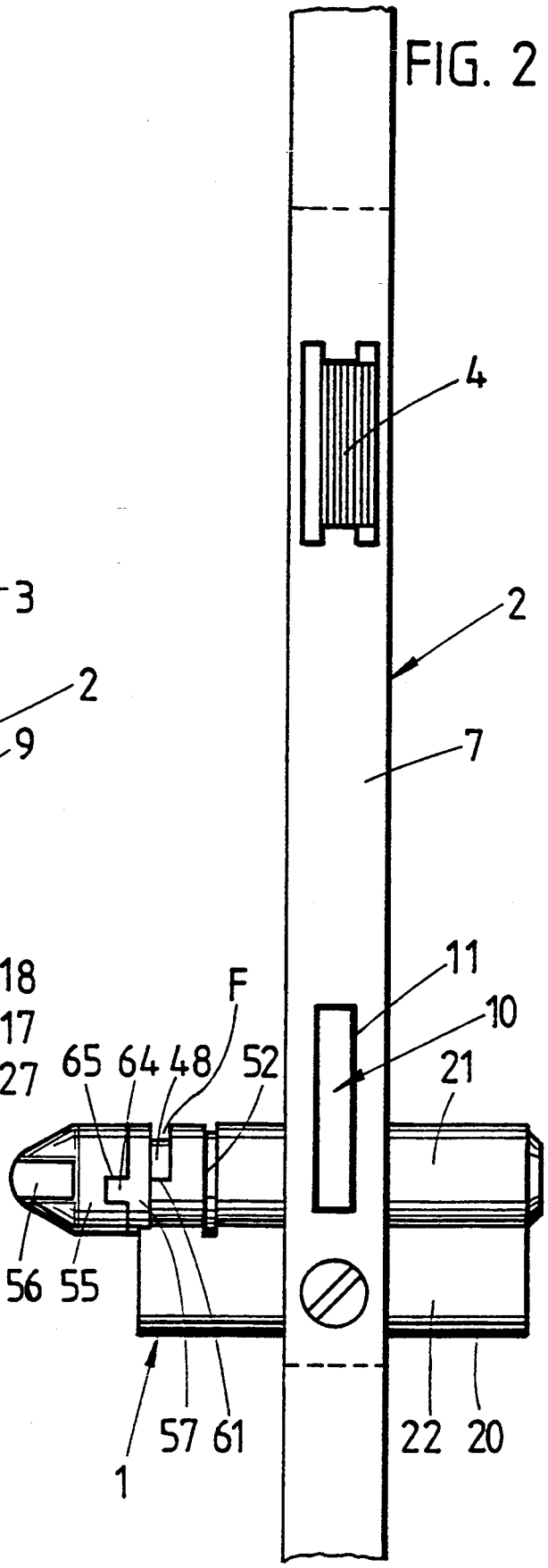
FIG. 2 is a side view of FIG. 1.

In the embodiment shown, the lock cylinder 1 developed in accordance with the invention is associated with a mortise lock 2 which closes upon a single turn. The lock has a latch 4 which can be actuated by means of a pusher nut 3. Upon displacement of the pusher nut 3 in the normal direction of opening, the latch 4 is retracted into the lock housing. If the pusher nut 3 is displaced in opposite direction, the latch 4 remains stationary, while only drive bars 5 and 6 are moved.

The mortise lock 2 has, in detail, a cover rail 7 with lock bottom 8 bent at right angle to it, parallel to which a lock cover 9 extends. Between the two, within the lower region of the mortise lock, a bolt 10 is displaceable, its bolt head 10' passing through an opening 11 of corresponding cross section in the cover rail 7. The bolt 10 forms a stepped-down bolt tail 10'', on the lower edge of which there is a lock engagement opening 12. Thus there is concerned a bolt 10 which can be advanced by a single turn.

On its edge opposite the lock engagement opening 12 the bolt tail 10'' has a blocking recess 13 for a blocking projection 14 of a tumbler 15 which can be displaced in the longitudinal direction of the mortise lock. A compression spring 16 constantly urges the tumbler 15 in the direction of engagement. For the guiding of the tumbler 15 pins 17 are provided which extend from it and enter into slots 18 in the lock cover 9.

The lock cylinder 1 which is held in a mortise opening 19 by lock bottom 8 and lock cover 9 is developed as a profiled cylinder. It has the cylinder housing 20 which consists of a circular section 21 and a flange section 22 extending radially thereto. In the center of the housing, there is a cut-out 23 which extends from the circular section 21 inward into the flange section 22 in order to receive a locking member 24. The latter has a locking-member hub 25 and a locking-member nose 26 which is radial thereto and cooperates with the lock engagement opening 12 of the bolt 10.

Figures 5, 6:
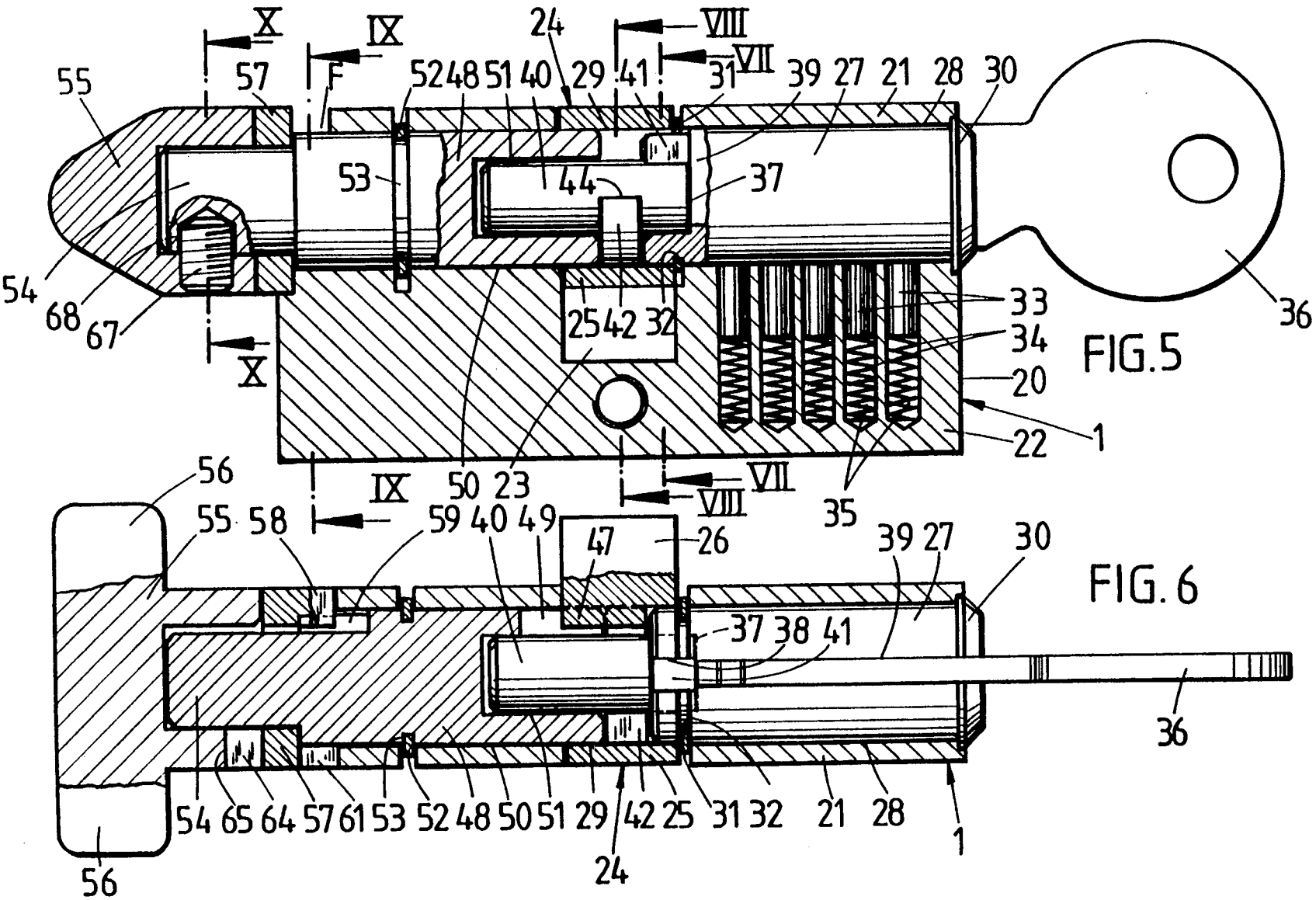
FIG. 5 shows, on a larger scale, a longitudinal section through the lock cylinder with the key inserted.
FIG. 6 is a horizontal section through the lock cylinder at the level of the axis of the cylinder core.
Figure 7:
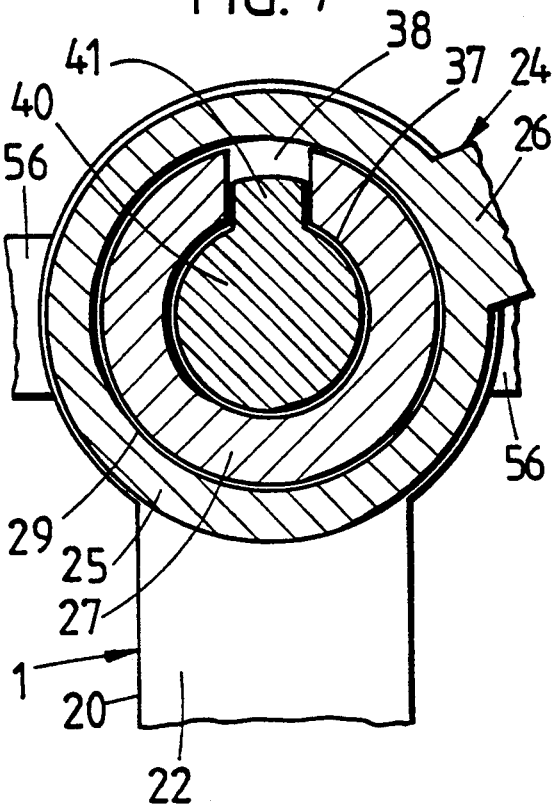
FIG. 7 is a section along the line VII—VII of FIG. 5.

The locking-member hub 25 is supported on one side by a cylinder core 27 which is mounted in a central core hole 28 in the circular section 21. The inward-lying front end of the cylinder core 27 extends partly into a locking member-hub hole 29. For the securing in axial position of the cylinder core 27, there is used its front collar 30 of larger diameter as well as a snap ring 31 which enters into an annular groove 32 arranged in the same height in the cylinder core 27; see, in particular, FIGS. 5 and 6. The cylinder core 27 contains core pins (not shown), which cooperate with housing pins 33 arranged in the cylinder housing 20. The housing pins 33 are arranged in pin holes 34 which extend radially to the cylinder core 27 and are arranged in a row, they furthermore have receiving pin springs 35 which urge the housing pins 33 in the direction of the cylinder core 27. When the key 36 is removed, the housing pins 33 displace the core pins (not shown) which are guided in corresponding holes in the cylinder core 27 and engage in part into the holes securing the cylinder core against rotation. The tumblers consisting of core pins and housing pins are so positioned by the inserted key that their parting joint lies at the height of the slide joint of the cylinder core. The cylinder core 27 is thus turnable.

At its free front end the cylinder core 27 has a blind hole 37 with slot 38 extending radial thereto. It extends in the plane of a key channel 39 provided in the cylinder core 27. The one end of a coupling member 40 developed as pin engages into the blind hole 37. From the end of this pin there extends a radially directed projection 41 which engages in the slot 38 and thus produces a connection, fixed in rotation, between cylinder core 27 and coupling member 40.

Adjoining the projection 41 and opposite it, a semicircular annular collar 42 is formed on the coupling member 40, the end surfaces 43, 44 of said collar cooperating with stop surfaces 45, 46 of a drive vane 47 extending into the hole 29 in the locking-member hub. The drive vane terminates in front of the cylinder core 27 and also in front of the projection 41 of the coupling member 40; see, in particular, FIG. 6. On the other side, the locking member 42 is borne by a spindle 48 which faces, in alignment, the cylinder core 27. The inward-facing end of the spindle 48 enters for this into the locking-member hole 29 and extends up to the annular collar 42. The inward-facing end of the spindle 48 has a radial slot 49 for coupling engagement with the drive vane 47. A mounting cavity 50 in the corresponding region of the circular section 21 serves to receive the spindle 48. On the inner front end of the spindle 48 there is a blind hole 51 into which the end of the coupling member protruding beyond the annular collar 42 extends.

For the axial securing in position of the spindle 48 a spring ring 52 is provided which engages in an annular groove 53 in the spindle 48.

The outward-facing end of the spindle 48 has a stepped-down extension 54 of circular cross section. The latter extends beyond the lock cylinder 1 on the corresponding end side. On the continuation 54 there is placed a knob 55 having two diametrically opposite actuating vanes 56 placed thereon. Between the knob 55 and the facing end edge of the mounting cavity 50 for the spindle 48 there is disk 57 from which a nose 58 pointing in the direction of the locking-member hub 25 extends. Said nose engages in coupling manner into a circumferential, longitudinally extending recess 59 in the spindle 48 and, together with the side surfaces 60, 61 of an end-side free space 5 of the cylinder housing 20, forms turn stops 62, 63.

Diametrically opposite the nose 58, there extends from the disk 57 another nose 64 extending in opposite direction. It engages into a depression 65 on the facing end of the knob 55. There are two such depressions 65, 66, so that the knob 55 can be brought into different positions of rotation. By the nose 64, a connection, fixed in rotation, is produced between the knob 55 and disk 57. Since the latter is coupled, fixed for rotation, via the nose 58 to the spindle 48, the turning of the knob 55 causes the direct driving of the spindle 48.

For the axial securing in position of the knob 55, there is used a set screw 67, the inner end of which extends into a depression 68 in the extension 54. Displaced at an angle to the depression 68, there is another depression 69 in the continuation 54 of the spindle 48. In accordance with the fixing in position of the hub 55 shown in the drawing, an angle $\alpha$ of about 68° is present between the depression 66 and the set screw 67 or depression 68. Between the set screw 67 and the nose 64 there is also an angle $\alpha$. An angle $\alpha$ is also present between the depression 69 and the nose 64.

Figure 3:
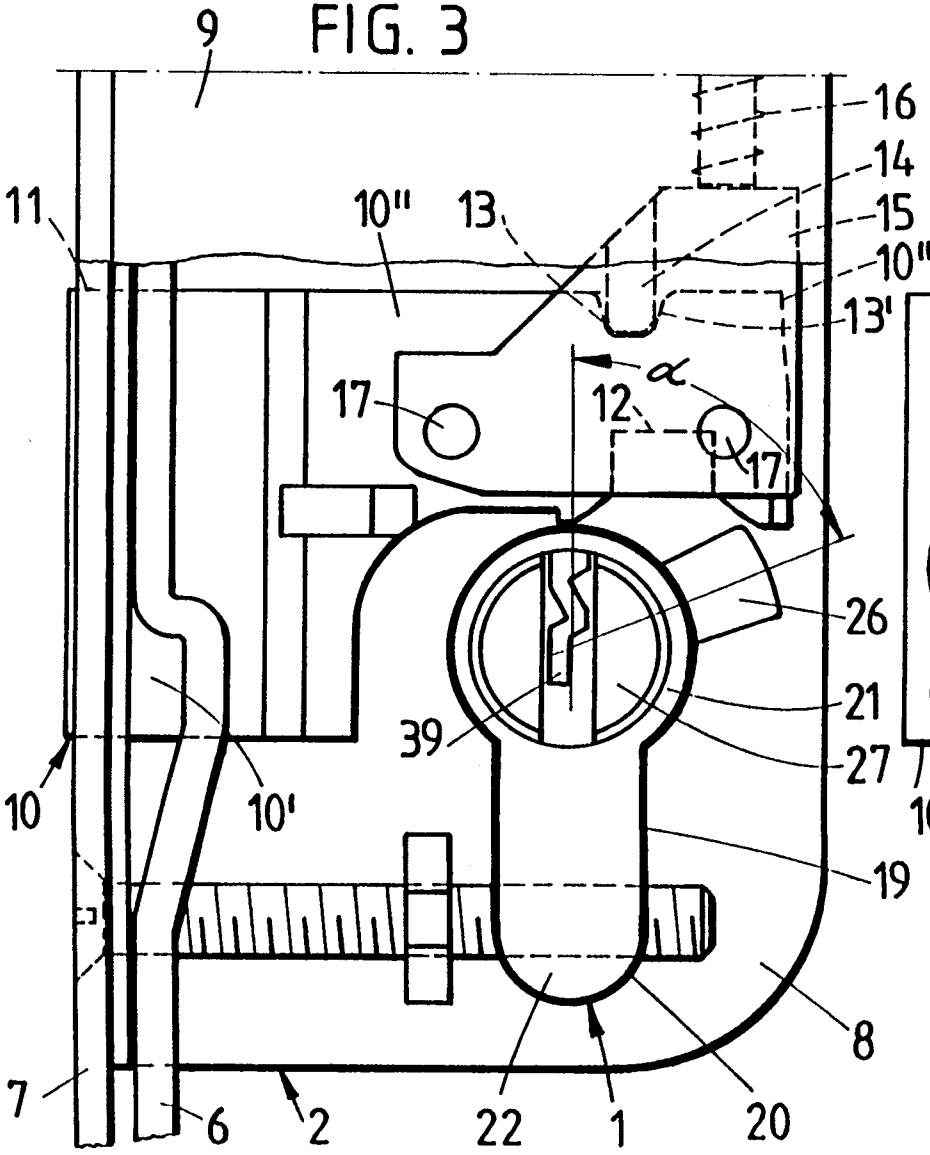
FIG. 3 shows, on a larger scale, the lower region of the mortise lock with the bolt retracted and with the lock cover partially broken away.
Figure 8:
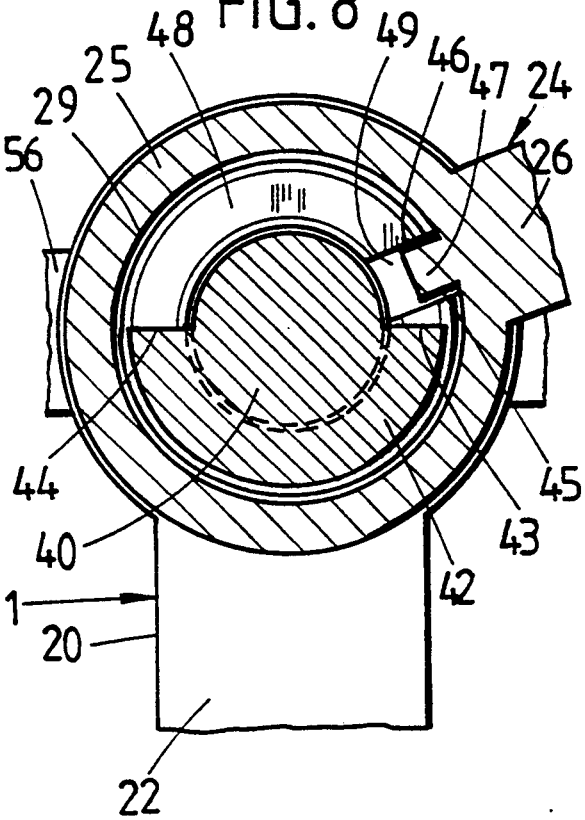
FIG. 8 is a section along the line VIII—VIII of FIG. 5.
Figure 9:
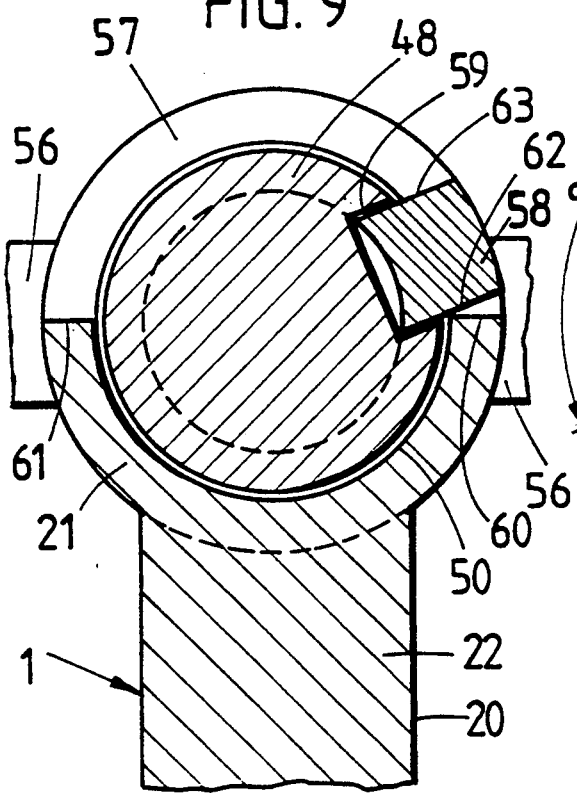
FIG. 9 is a section along the line IX—IX of FIG. 5.
Figure 10:
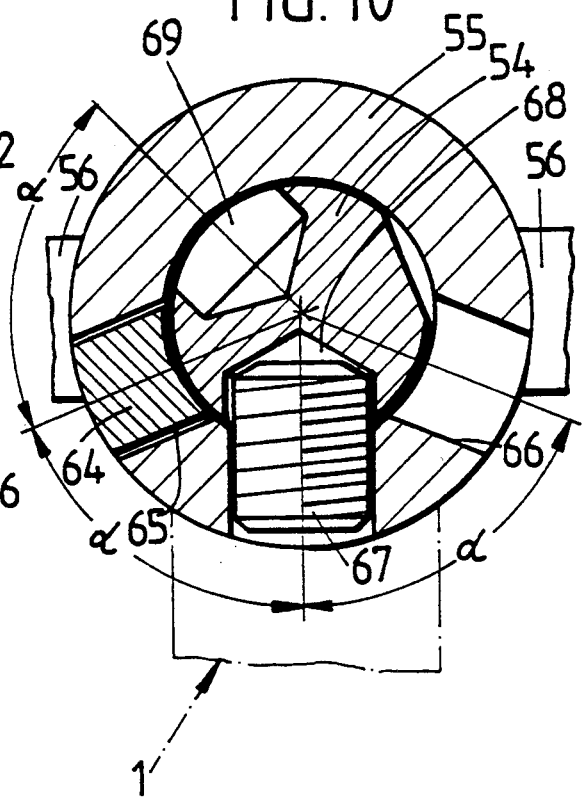
FIG. 10 is a section along the line X—X of FIG. 5.
Figure 11:
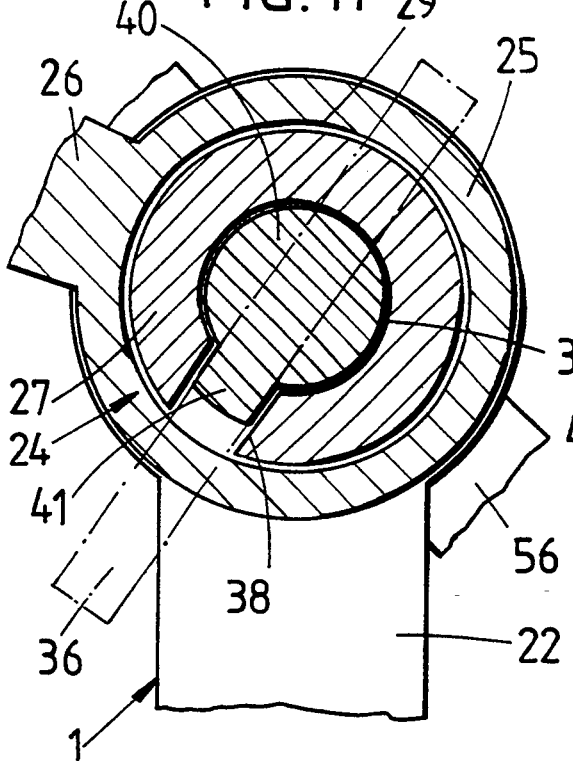
FIG. 11 is a showing corresponding to FIG. 7, but in the entrainment end position of the coupling member.

In the starting position, the nose 58 of the disk 67 by means of its turn stop 62 strikes the side surface 60. The locking member nose 26 then assumes the position shown in FIG. 3. This means that the bolt 10 is moved back. Then the drive vane 47, which is coupled with the spindle 48, is also located in front of the end surface 43 of the annular collar 42 of the coupling member 40; see FIG. 8.

In the starting position, and therefore with the bolt 10 retracted, the two actuating vanes 56 of the knob 55 are in horizontal position, which indicates from the inside of the door that the bolt 10 is retracted.

Figure 4:
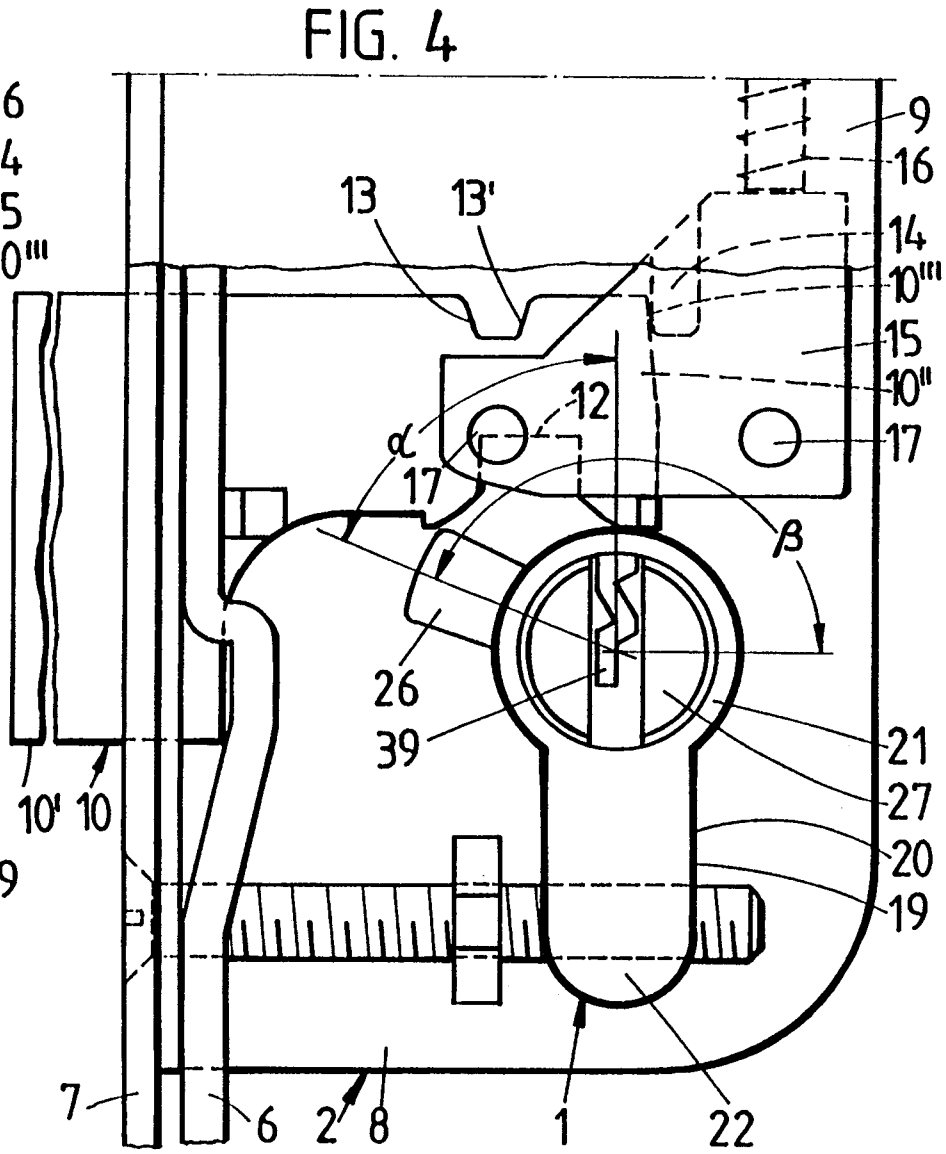
FIG. 4 is a view corresponding to FIG. 3, with the bolt advanced by means of the locking member which has passed over a locking path of less than 180° upon this process.
Figure 12:
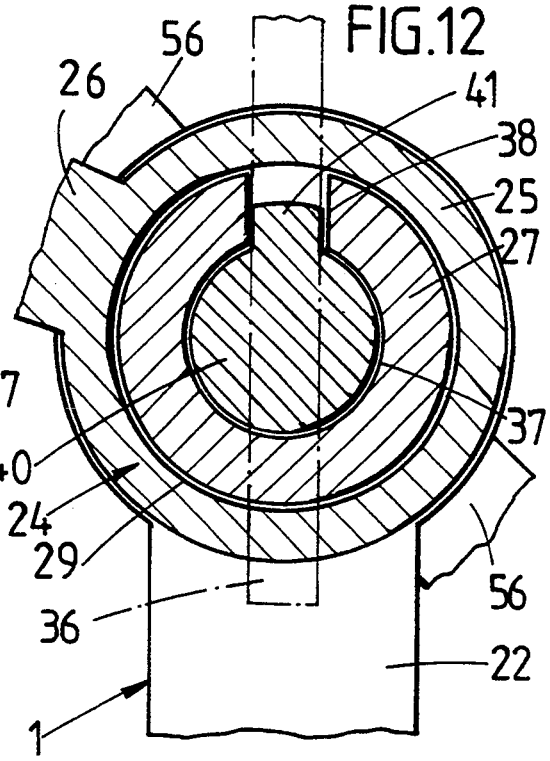
FIG. 12 is a showing, based on FIG. 11, in which the coupling member has been brought back into its starting position from the entrainment end position by turning the cylinder core back into the key-removal position.
Figure 13:
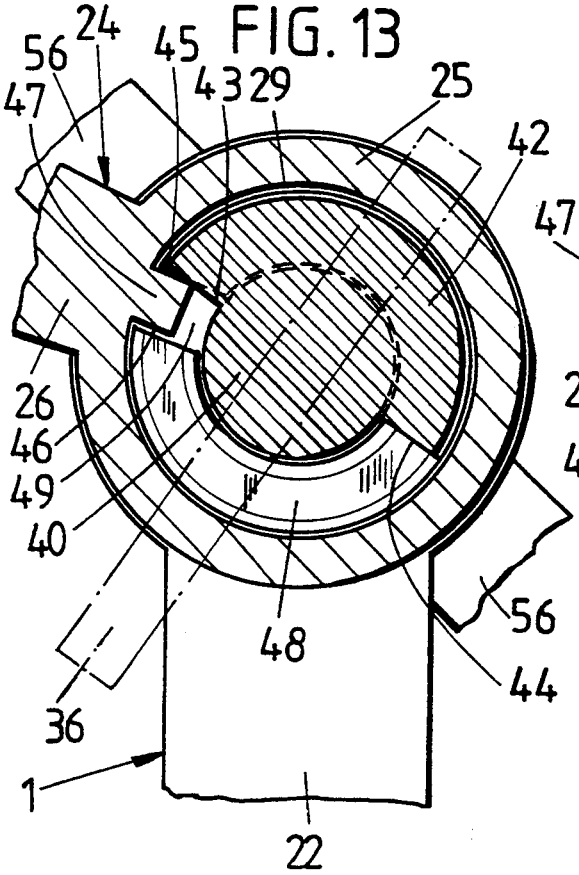
FIG. 13 is a view corresponding to FIG. 8, but showing the entrainment end position of the coupling member.
Figure 14:
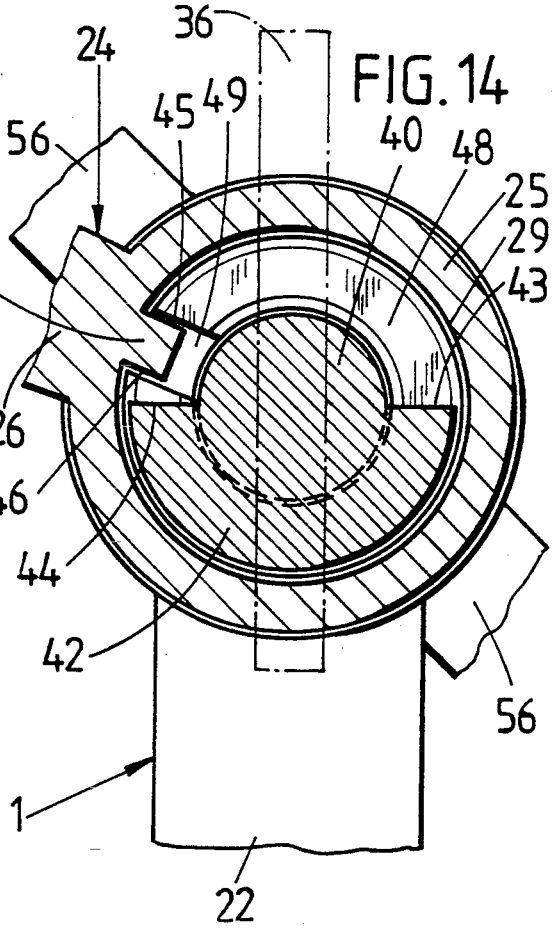
FIG. 14 is a view based on FIG. 13, in which the coupling member is in the starting position as a result of the turning of the cylinder core back into the key-removal position.
Figure 15:
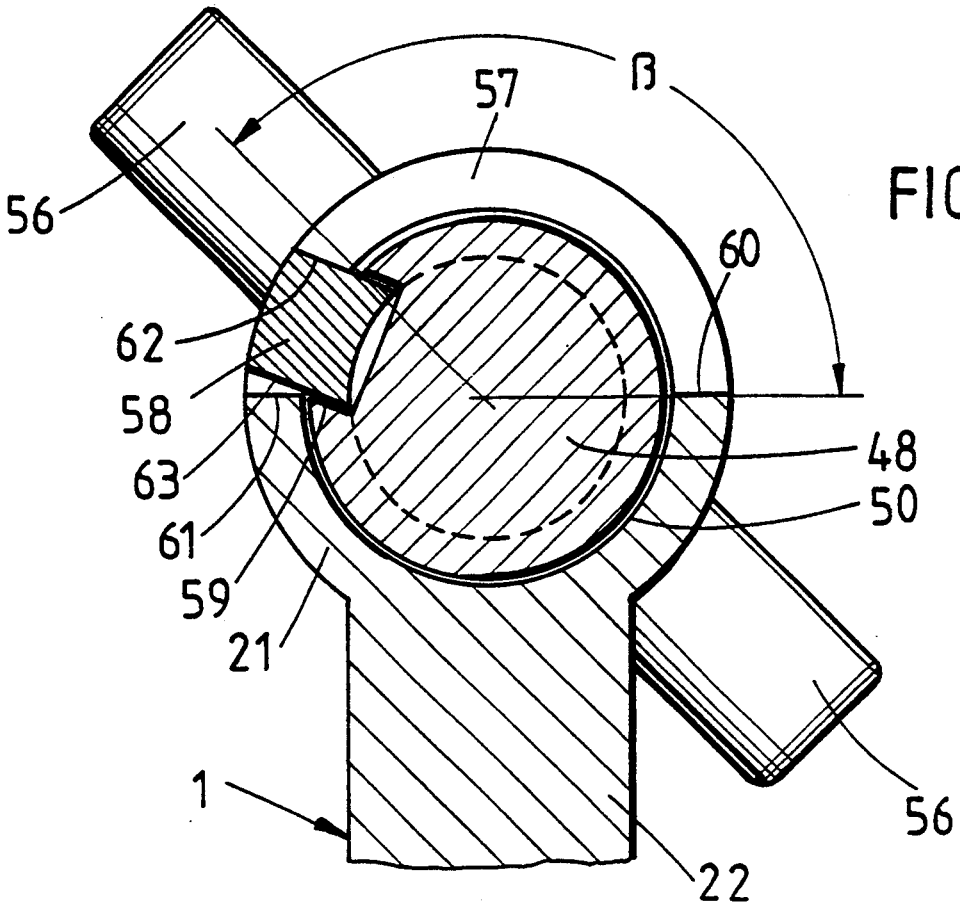
FIG. 15 is a view corresponding to FIG. 9 in which, differing from the latter, the locking pin has passed with the knob into the position which corresponds to the position of advance of the bolt.
Figure 16:
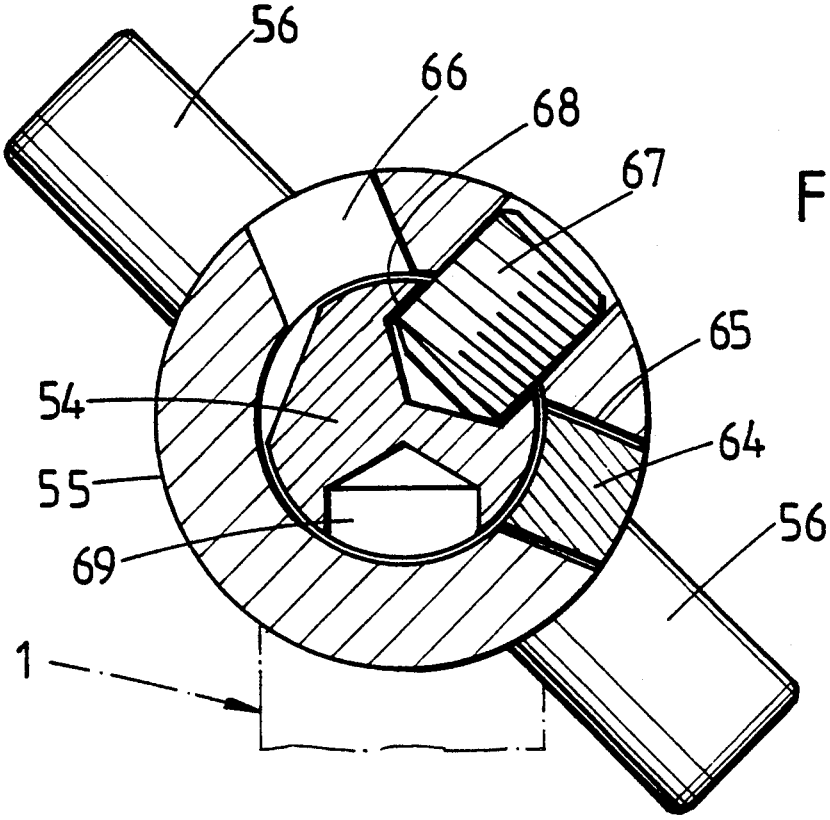
FIG. 16 is a showing corresponding to FIG. 10, also concerning the position of advance of the bolt.

The manner of operation is as follows:

The advancing of the bolt from the outside of the door requires the introduction of the proper key 36 into the key channel 39 of the cylinder core 27. The tumblers are positioned in proper manner by the key 36, permitting the following turning of the cylinder core 27. The advancing of the bolt 10 requires a locking rotation of the cylinder core 27 in counterclockwise direction. In this connection, the locking-member nose 26 enters in coupling fashion into the lock engagement opening 12 of the bolt tail 10''. With the simultaneous lifting of the tumbler 15 into a position of release, the bolt 10 can then be moved forward. During the locking rotation of the cylinder core 27 the coupling member 40 is carried along directly as a result of the projection/slot engagement. The end surface 43 of the annular collar 42 strikes the drive vane 47 and turns the locking-member hub 25 into the end entrainment position shown in FIG. 4 by an angle $\beta$ of 136°. The angle $\beta$ is therefore twice as great as the angle $\alpha$. The starting position and the end entrainment position are, in this connection, symmetric to the longitudinal center axis of the locking cylinder 1. This means that in each case the locking-member nose 26 forms an angle $\alpha$ with the longitudinal center plane of the locking cylinder 1; see FIGS. 3 and 4. The end entrainment position results from the fact that the nose 58 of the disk 57, by means of its turn stop 63, strikes the side surface 61 of the end-side free space F; see FIG. 15. This end entrainment position can furthermore be noted from FIGS. 11, 13, 15 and 16 in which the knob 55 has also been displaced by the angle $\beta$. It can therefore be noted from the inside of the door that the bolt 10 is advanced. To be sure, the key 36 cannot be removed after this turning motion. Rather, the cylinder core 27 must be turned back by means of the key 36. The coupling member 40 is carried along positively in this connection via the cylinder core 27, so that the position shown in FIGS. 12 and 14 is thereby reached. The free turning back of the coupling member 40 with respect to the locking-member hub 25 is possible due to the free passage between the two. From FIGS. 13 and 14 it can be noted that, during the turning back, the end surface 44 of the annular collar 42 passes in front of the stop surface 46 of the drive vane 47 of the locking-member hub 25. The locking member 25 is therefore not carried along and thus the knob 55 is not carried along either.

The retraction of the bolt 10 requires a locking rotation of the cylinder core 27 by means of the key 36 in clockwise direction. The end surface 44 of the coupling member 40 which is carried along in this connection strikes against the stop surface 46 of the drive vane 47 and positively turns the locking member 24 with locking-member nose 26. In hand with this, the spindle 48, disk 57 and knob 54 are also carried along. During the retraction rotation, the locking-member nose 26 lifts the tumbler 15 into a position of release. The locking rotation is completed when the nose 58 of the disk 57 strikes the side surface 60 of the end-side free space F. The knob 55 with spindle 48 then again assumes the starting position. Due to the free passage between coupling member 40 and locking-member hub 25, the cylinder core 27 can again be turned back, with simultaneous carrying along of the coupling member 40, into the key-removal position, establishing the starting position as shown in FIGS. 7 to 10.

From the inside of the door it is possible, by means of the knob 55—even if the key is not inserted—to effect the moving forward and back of the bolt 10. In this connection, the locking-member hub 25 is carried along via the spindle 48, the drive vane 47 moving from the one end surface of the collar 42 to the other as a result of the free passage.

The rear flank 13' of the blocking recess 13, as well as the rear flank 10''' of the bolt tail 10'', are inclined so that, in the event of incomplete advance or retraction, the blocking projection 14 of the spring-loaded tumbler 15 forces the bolt 10 into its end position.

I claim:

1. A lock cylinder which is actuatable from one side by means of a knob and from the other side by means of a key, the cylinder comprising a knob, and a locking member hub disposed in a central region of the lock cylinder and connected, fixed for rotation, with the knob;

a cylinder core coaxial with the locking member hub and having tumblers adapted to be set by the key, and a coupling member encircled by the locking member hub;

wherein a free travel space is provided between the coupling member and the locking member hub allowing the coupling member to carry the locking member hub in an entrained position upon rotation of the coupling member only in one direction of rotation, the free space allowing the coupling member to turn back freely from the entrained position into a key-removal position of the cylinder core;

the coupling member is configured as a cylindrical pin, and extends between the cylinder core and the locking member hub to produce a connection, fixed in rotation, between the cylinder core and the locking member hub;

the coupling member comprises a semicircular annular collar having end surfaces; and the lock cylinder further comprises a drive vane extending inwardly from the locking member hub and having stop surfaces for abutting the end surfaces of the semicircular annular collar, the drive vane extending into the free space of the locking member hub.

2. A lock cylinder according to claim 1, wherein the coupling member is in form-locked projection/slot engagement with the end side of the cylinder core.

3. A lock cylinder according to claim 1, further comprising a spindle having an annulus disposed between the coupling member and the locking member hub; and wherein the knob is seated, movable into different positions of rotation, on the spindle, the spindle extends up into the locking-member hub, and said locking-member hub is in form-locked engagement with said spindle.

4. A lock cylinder according to claim 3, further comprising a mounting cavity for receiving the spindle, a nose extending outward radially from a recess in the spindle, and a disk which is seated on the spindle between the knob and end edge of the mounting cavity;

wherein there is an end-side free space on a side of the disk facing the spindle; and said disk, via the nose faces in the direction of the locking-member hub and has rotation stops with side surfaces of the end-side free space.

5. A lock cylinder according to claim 4, further comprising a second nose located diametrically opposite said first-mentioned nose and facing in a direction opposite said first-mentioned nose, said disk being operatively coupled to both of said noses;

wherein said knob has a first and a second depression for receiving said second nose, said first and said second depressions being spaced apart circumferentially about said know; and said second nose is directed away from the locking-member hub and is adapted to be brought into form-locked engagement with individual ones of said depressions.

* * * * *